US007477011B2

(12) United States Patent
Jeon et al.

(10) Patent No.: US 7,477,011 B2
(45) Date of Patent: Jan. 13, 2009

(54) CATHODE SUBSTRATE FOR ELECTRON EMISSION DEVICE AND ELECTRON EMISSION DEVICE WITH THE SAME

(75) Inventors: Sang-Ho Jeon, Suwon-si (KR); Byong-Gon Lee, Suwon-si (KR); Sang-Hyuck Ahn, Suwon-si (KR); Su-Bong Hong, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 439 days.

(21) Appl. No.: 11/286,384

(22) Filed: Nov. 25, 2005

(65) Prior Publication Data

US 2006/0186787 A1 Aug. 24, 2006

(30) Foreign Application Priority Data

Feb. 24, 2005 (KR) ..... 10-2005-0015311

(51) Int. Cl.
*H01J 1/02* (2006.01)
*H01J 63/04* (2006.01)

(52) U.S. Cl. ..... 313/496; 313/462; 313/308; 313/309; 313/311

(58) Field of Classification Search ..... 313/461, 313/462, 466, 308, 495–497, 309, 336, 351
See application file for complete search history.

(56) References Cited

U.S. PATENT DOCUMENTS

| | | | | |
|---|---|---|---|---|
| 5,081,394 | A * | 1/1992 | Morishita et al. | 313/466 |
| 7,019,449 | B2 * | 3/2006 | McCreery | 313/311 |
| 2004/0041508 | A1 * | 3/2004 | Sugino et al. | 313/309 |
| 2004/0070328 | A1 * | 4/2004 | Van den Bergh et al. | 313/461 |
| 2006/0043878 | A1 * | 3/2006 | Yoshii et al. | 313/497 |
| 2006/0108906 | A1 * | 5/2006 | Gosain et al. | 313/309 |

* cited by examiner

*Primary Examiner*—Ashok Patel
(74) *Attorney, Agent, or Firm*—Robert E. Bushnell, Esq.

(57) ABSTRACT

In an electron emission device, the surface roughness of a substrate with driving electrodes and an insulating layer is optimized. The electron emission device includes first and second substrates facing each other with a predetermined distance therebetween. An electron emission unit is formed on a surface of the first substrate facing the second substrate, and includes electron emission regions, a plurality of driving electrodes, and an insulating layer for insulating the driving electrodes from each other. A light emission unit is formed on a surface of the second substrate facing the first substrate, and includes phosphor layers and an anode electrode. The first substrate satisfies the following condition: 0.5 nm≦Ra≦1.8 nm, where Ra indicates the average roughness of the surface of the first substrate facing the second substrate.

13 Claims, 4 Drawing Sheets

CATHODE SUBSTRATE FOR ELECTRON EMISSION DEVICE AND ELECTRON EMISSION DEVICE WITH THE SAME

CLAIM OF PRIORITY

This application makes reference to, incorporates the same herein, and claims all benefits accruing under 35 U.S.C.§119 from an application for CATHODE SUBSTRATE FOR ELECTRON EMISSION DEVICE AND ELECTRON EMISSION DEVICE WITH THE SAME earlier filed in the Korean Intellectual Property Office on 24 Feb. 2005 and there duly assigned Serial No. 10-2005-0015311.

BACKGROUND OF THE INVENTION

1. Field of the Invention

The present invention relates to an electron emission device, and in particular, to an electron emission device which has first and second substrates sealed with respect to each other and forming a vacuum structure.

2. Description of Related Art

Generally, electron emission devices are classified into a first type wherein a hot cathode is used as an electron emission source, and a second type wherein a cold cathode is used as the electron emission source.

The second type of electron emission device includes a field emitter array (FEA) type, a surface-conduction emission (SCE) type, a metal-insulator-metal (MIM) type, and a metal-insulator-semiconductor (MIS) type.

The MIM type and the MIS type electron emission devices have metal/insulator/metal (MIM) electron emission regions and metal/insulator/semiconductor (MIS) electron emission regions, respectively. When voltages are applied to the two metallic layers or to the metallic and the semiconductor layers, electrons are expelled and accelerated from the metallic layer or the semiconductor layer having a high electric potential to the metallic layer having a low electric potential, thereby creating the electron emission.

The SCE type electron emission device includes first and second electrodes formed on a substrate and facing each other, and a conductive thin film disposed between the first and second electrodes. Micro-cracks are formed in the conductive thin film so as to create electron emission regions. When voltages are applied to the electrodes while an electric current flows to the surface of the conductive thin film, electrons are emitted from the electron emission regions.

The FEA type electron emission device is based on the principle that, when a material having a low work function or a high aspect ratio is used as an electron emission source, electrons are easily emitted from the electron emission source when an electric field is applied thereto under vacuum atmosphere conditions. A carbonaceous material, such as carbon nanotube, or a sharp-pointed tip structure based on molybdenum Mo or silicon Si, has been developed for use as the electron emission source.

Although the specific structure of the electron emission device is differentiated depending upon the type thereof, the basic structure includes a first substrate, a second substrate facing the first substrate, and a sidewall surrounding the peripheries of the two substrates so as to form an inner space. The inner space is maintained in a vacuum state so that electrons are freely emitted and migrated therein.

Driving electrodes are formed on the first substrate to control the electron emission of the electron emission regions, and an anode electrode is formed on the second substrate together with phosphor layers so as to accelerate the electrons emitted from the first substrate toward the phosphor layers. With this structure, the phosphor layers are excited by the electrons emitted from the electron emission regions so as to emit visible rays, thereby causing light emission or image display.

The first substrate is commonly formed with glass so that it has a surface roughness which is altered in various manners. When, during preparation of the first substrate, structural components such as driving electrodes, insulating layers for insulating the driving electrodes from each other, and electron emission regions are formed, the surface roughness of the first substrate capable of optimizing the formation of those structural components has been left out of consideration.

When an insulating layer is formed on a first substrate with a high surface roughness, the surface roughness thereof is increased so that thermal distortion of the first substrate and the insulating layer is caused during the process of firing the insulating layer, thereby deteriorating the surface evenness of the insulating layer. The deteriorated surface evenness of the insulating layer causes cracks so that leakage of current through the cracks or a short circuit between the driving electrodes may result.

In contrast, when a driving electrode is formed on a first substrate with a very low surface roughness, the surface evenness of the driving electrode is enhanced, but adhesion of the driving electrode to the first substrate is reduced so that the driving electrode may be easily released during the subsequent processing steps.

SUMMARY OF THE INVENTION

In one exemplary embodiment of the present invention, an electron emission device optimizes the surface roughness of the first substrate so as to increase the surface evenness of the driving electrodes and the insulating layer, and prevents the releasing of the driving electrode from the first substrate.

In an exemplary embodiment of the present invention, the electron emission device includes first and second substrates facing each other with a predetermined distance therebetween. An electron emission unit having electron emission regions, a plurality of driving electrodes, and an insulating layer for insulating the driving electrodes from each other is formed on a surface of the first substrate facing the second substrate. A light emission unit having phosphor layers and an anode electrode is formed on a surface of the second substrate facing the first substrate. The first substrate satisfies the following condition: $0.5\ \text{nm} \leqq Ra \leqq 1.8\ \text{nm}$, where Ra indicates the average roughness of the surface of the first substrate facing the second substrate.

The driving electrodes include cathode electrodes and gate electrodes extending in directions perpendicular to each other while interposing the insulating layer, and the electron emission regions are connected to the cathode electrodes.

The electron emission regions are formed from a material selected from carbon nanotube, graphite, graphite nanofiber, diamond, diamond-like carbon, $C_{60}$, or silicon nanowire.

In another exemplary embodiment of the present invention, a cathode substrate for the electron emission device has a substrate, and an electron emission unit having electron emission regions, a plurality of driving electrodes, and an insulating layer for insulating the driving electrodes from each other is formed on the substrate. The substrate satisfies the following condition: 0.5 nm≦Ra≦1.8 nm, where Ra indicates the average roughness of the substrate.

BRIEF DESCRIPTION OF THE DRAWINGS

A more complete appreciation of the invention and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
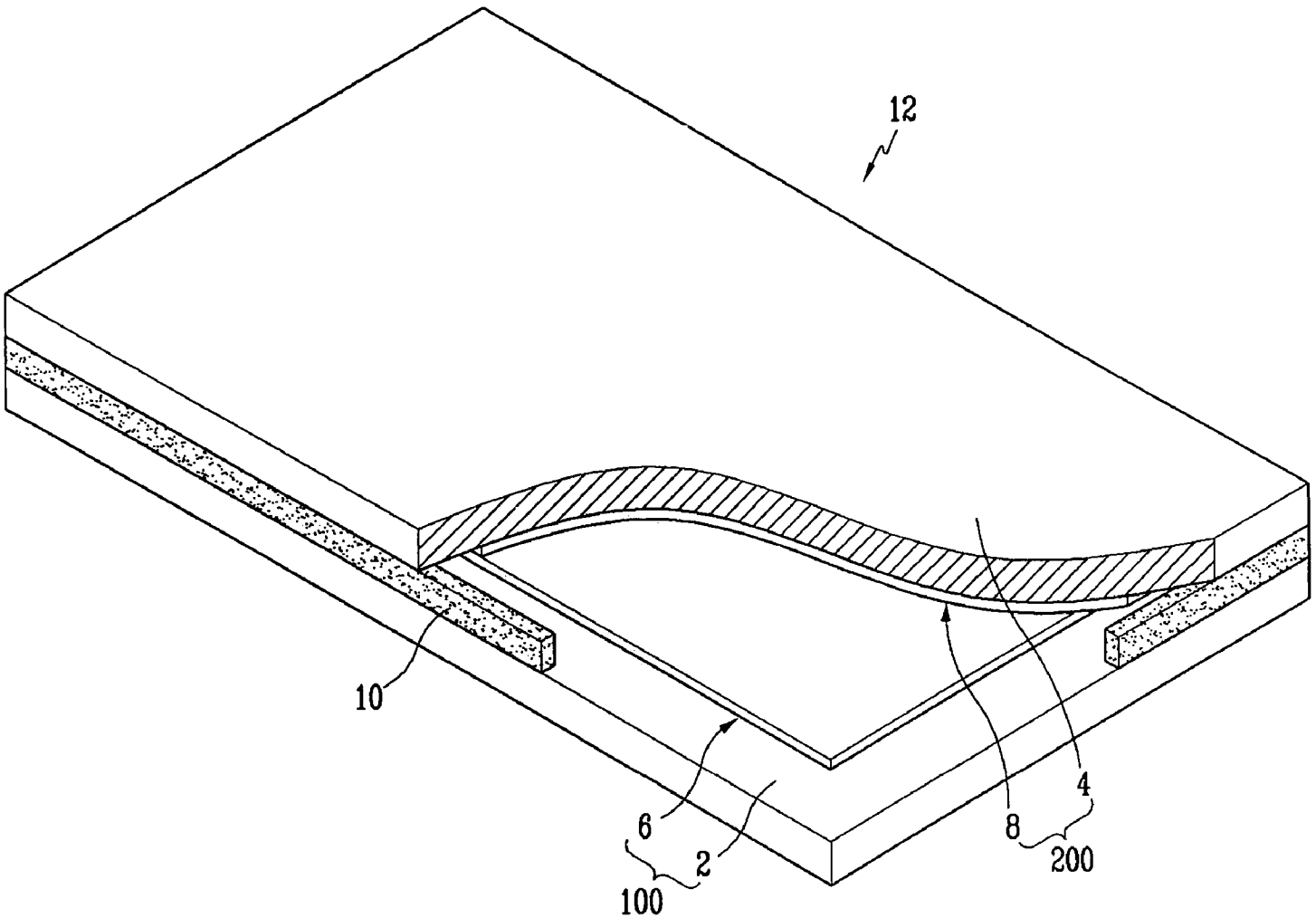
FIG. 1 is a partial exploded perspective view of an electron emission device according to an embodiment of the present invention.

FIG. 1 is a partial exploded perspective view of an electron emission device according to an embodiment of the present invention.

As shown in FIG. 1, the electron emission device includes cathode and anode substrates 100 and 200, respectively, facing each other with a predetermined distance therebetween.

The cathode substrate 100 includes a first substrate 2 and an electron emission unit 6 formed on the first substrate 2 to emit electrons, and the anode substrate 200 includes a second substrate 4 and a light emission unit 8 formed on the second substrate 4 to cause light emission or image display with the electrons emitted from the electron emission unit 6.

Spacers (not shown) are attached to any one of the first substrate 2 and second substrate 4, and a sidewall 10 is placed at the peripheries of the substrates 2 and 4. The peripheries of the substrates 2 and 4 are sealed to each other using a seal frit (not shown). The inner space between the substrates 2 and 4 is exhausted under a pressure of $10^{-6}$ to $10^{-7}$torr so as to be in a vacuum state, thereby forming a vacuum structure. The first substrate 2 and the second substrate 4 are commonly formed with glass.

The specific structure of the electron emission unit and the light emission unit will now be explained with respect to a field emitter array (FEA) type electron emission device. The FEA type electron emission device has cathode electrodes and gate electrodes as the driving electrodes for controlling the electron emission.

Figure 2:
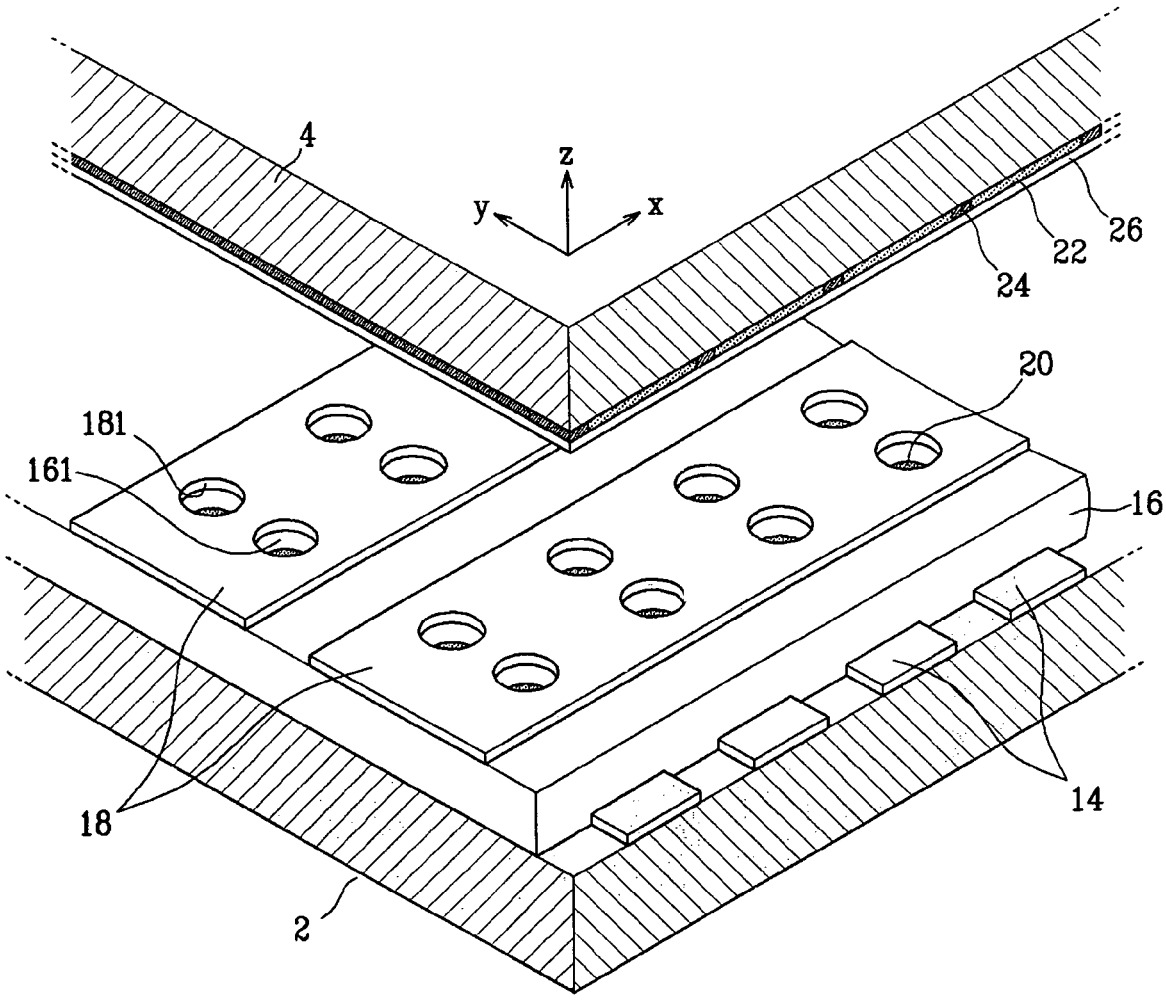
FIG. 2 is a partial exploded perspective view of a field emitter array (FEA) type electron emission device according to an embodiment of the present invention.
Figure 3:
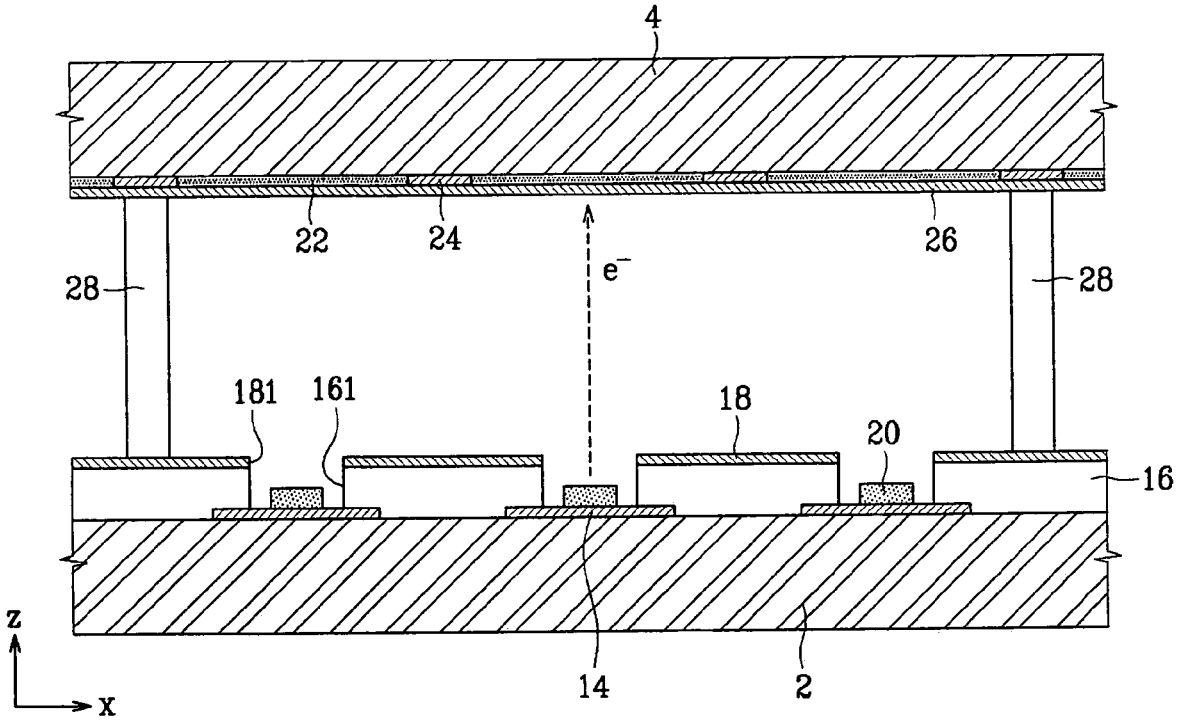
FIG. 3 is a partial sectional view of the FEA type electron emission device according to the embodiment of the present invention.

FIG. 2 is a partial exploded perspective view of a field emitter array (FEA) type electron emission device according to an embodiment of the present invention, and FIG. 3 is a partial sectional view of the FEA type electron emission device according to the embodiment of the present invention.

As shown in FIGS. 2 and 3, cathode electrodes 14 are stripe-patterned on the first substrate 2 while extending in a direction of the first substrate 2 (in the direction of the y axis of the drawing), and an insulating layer 16 is formed on the entire surface of the first substrate 2 while covering the cathode electrodes 14. A plurality of gate electrodes 18 is formed on the insulating layer 16 and extends in a direction perpendicular to the cathode electrodes 14 (in the direction of the x axis of the drawing).

The insulating layer 16 may be formed by performing screen printing, drying and firing one or more times so that it has a thickness of 5~15 μm, or through CVD-depositing $SiO_2$ so that it has a smaller thin thickness of 5 μm or less.

In this embodiment, when the crossed regions of the cathode electrodes 14 and the gate electrodes 18 are defined as the pixel regions, at least one electron emission region 20 is formed on each cathode electrode 14 at each pixel region. Opening portions 161 and 181 are formed on the insulating layer 16 and the gate electrodes 18 corresponding to the electron emission regions 20 while exposing the electron emission regions 20 on the first substrate 2.

The electron emission regions 20 are formed from a material which emits electrons when an electric field is applied thereto under a vacuum atmosphere, such as a carbonaceous material or a nanometer-sized material. The electron emission regions 20 are, preferably, formed from carbon nanotube, graphite, graphite nanofiber, diamond, diamond-like carbon, $C_{60}$, silicon nanowire, or a combination thereof. The electron emission regions 20 may be formed through direct growth, screen printing, chemical vapor deposition (CVD), or sputtering.

Alternatively, the electron emission regions may be formed as a front sharp-pointed tip structure (not shown) based on molybdenum Mo or silicon Si, and altered with various materials and shapes.

Red, green and blue phosphor layers 22 are formed on a surface of the second substrate 4 facing the first substrate 2 while being spaced apart from each other by a predetermined distance, and black layers 24 are disposed between the neighboring phosphor layers 22 to enhance the screen contrast.

An anode electrode 26 is formed on the phosphor layers 22 and the black layers 24 from a metallic material, such as aluminum, through deposition. The anode electrode 26 receives the voltage required for accelerating the electron beams (a direct current voltage of several hundreds to several thousands volts) from an external source, and reflects the visible rays radiated from the phosphor layers 22 to the first substrate 2 toward the second substrate 4 so as to increase screen luminance.

Alternatively, the anode electrode may be formed from a transparent material, such as indium tin oxide (ITO). In this case, the anode electrode (not shown) is formed on a surface of the phosphor layers 22 and the black layers 24 facing the second substrate 4. The anode electrode may be formed on the entire surface of the second substrate 4, or may be patterned with a plurality of separate portions.

The reference numeral 28 of FIGS. 2 and 3 indicates spacers disposed between the first substrate 2 and the second substrate 4 so as to space them apart from each other with a predetermined distance therebetween, and to support the vacuum structure.

When driving voltages are applied to the cathode electrodes 14 and the gate electrodes 18, an electric field is formed around the electron emission regions 20 due to the voltage difference between the electrodes 14 and 18, and electrons are emitted from the electron emission regions 20. The emitted electrons are attracted by the high voltage applied to the anode electrode 26, and are directed toward the second substrate 4, thereby colliding against the corresponding phosphor layers 22 and causing the emission of light from the phosphor layers 22.

With the above-structured electron emission device, the first substrate 2 overlaid with the electrodes 14 and 18 and the insulating layer 16 has an average roughness to be described below so as to increase the surface evenness of the electrodes 14 and 18 and the insulating layer 16, and to reinforce the adhesion of the cathode electrodes 14 to the first substrate 2.

Figure 4:
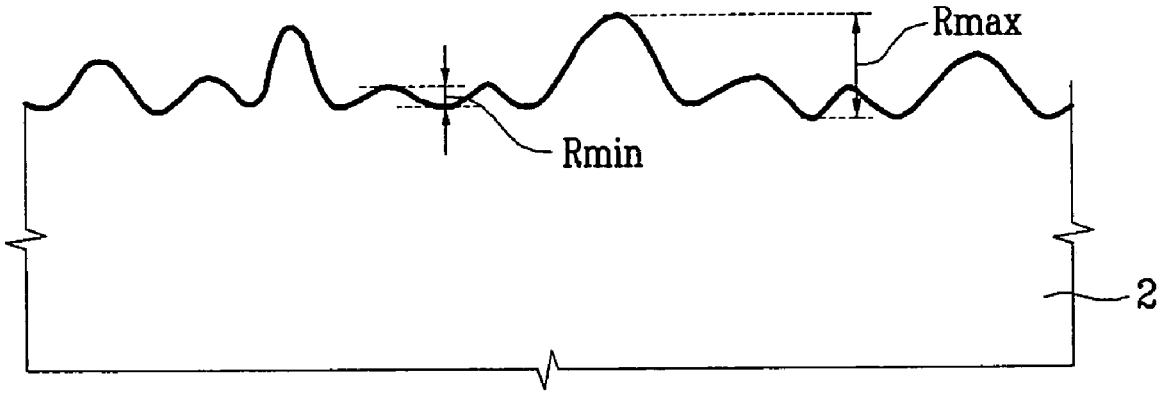
FIG. 4 is a partial amplified sectional view of a first substrate for the electron emission device according to the embodiment of the present invention.

FIG. 4 is a partial amplified sectional view of a first substrate for the electron emission device according to the embodiment of the present invention.

As shown in FIG. 4, the surface of the first substrate 2 is formed with prominent and depressed portions so that a peak and a valley are repeatedly arranged with the result that the first substrate 2 has a surface roughness. When the largest distance between a peak and a valley measured along the thickness of the first substrate 2 (in the direction of the z axis of the drawing) is indicated by the maximum roughness Rmax, and when the shortest distance between them is indicated by the minimum roughness Rmin, the average roughness Ra refers to the average value between the maximum roughness Rmax and the minimum roughness Rmin, and the first substrate 2 has an average roughness satisfying the following formula 1.

$$0.5\ \text{nm} \leqq Ra \leqq 1.8\ \text{nm} \quad (1)$$

Table 1 lists the measurement results related to the state of the insulating layer 16, the withstand voltage characteristic of the insulating layer 16, and the adhesion of the cathode electrodes 14 to the first substrate 2 measured when several sheets of first substrates 2 differentiated in average surface roughness were prepared, and an electron emission unit was formed on the respective first substrates 2.

The insulating layer 16 of the electron emission unit used in the experiments has a thickness of 4 μm, and the cathode electrode has a thickness of 2000-3000 Å. Chromium (Cr) was used to form the cathode electrodes 14 by means of sputtering.

TABLE 1

| | Com. 1 | Ex. 1 | Ex. 2 | Ex. 3 | Ex. 4 | Com. 2 | Com. 3 | Com. 4 |
|---|---|---|---|---|---|---|---|---|
| Average Roughness (nm) | 0.1 | 0.5 | 1.0 | 1.5 | 1.8 | 2.0 | 3.0 | 5.0 |
| State of insulating layer | Δ | Δ | ◎ | ○ | ○ | ○ | X | X |
| Withstand voltage characteristic | 180 V | 240 V | 300 V | 270 V | 260 V | 200 V | 150 V | 150 V |
| Adhesion of electrode | Δ | ◎ | ○ | ○ | ○ | ◎ | ◎ | ◎ |

(Com.: Comparative Example, Ex.: Example)

With respect to Table 1, the state of the insulating layer 16 was determined in dependence upon the occurrence of cracks, and is indicated by the sequence of ◎, ○, Δ, and X, where the number of cracks decreases. The withstand voltage characteristic indicates the maximum difference of voltages capable of being applied to the cathode electrodes 14 and the gate electrodes 18 without deconstructing the insulation of the insulating layer 16. The adhesion of the electrodes was obtained by measuring the degree of releasing of the electrode material after the adhesive tape was attached to the cathode electrodes 14 and detached, and indicated by the sequence of ◎, ○, Δ, and X where the releasing of the electrode material is decreased.

As listed in Table 1, with the Examples 1 to 4 where the average roughness of the first substrate 2 satisfied the condition of formula 1, it turned out that the first condition where the occurrence of cracks of the insulating layer 16 is reduced, the second condition where the withstand voltage characteristic is excellent, and the third condition where the adhesion of the electrodes is excellent, were simultaneously satisfied.

The first substrate 2, with the previously-identified average roughness, is advantageous in increasing the surface evenness of the insulating layer 16, and in preventing the occurrence of cracks when the insulating layer 16 has a small thickness of 5 μm or less.

It is explained above, with reference to the FEA type electron emission device, that the electron emission regions are formed with a material emitting electrons under the application of an electric field, and the cathode electrodes 14 and the gate electrodes 18 control the electron emission, but the inventive structure is not limited thereto, and may be applied to the SCE type, the MIM type and the MIS type with appropriate modifications.

With the electron emission device according to the present invention, the surface roughness of the first substrate 2 is optimized, thereby enhancing the surface evenness of the electrodes 14 and 18 and the insulating layer 16, preventing the occurrence of cracks in the insulating layer 16, and reinforcing the adhesion of the electrodes 14 and 18 to the first substrate 2. Consequently, the withstand voltage characteristic of the insulating layer 16 is improved so that the electron emission characteristic is enhanced, and the releasing of the electrodes 14 and 18 is prevented.

Although preferred embodiments of the present invention have been described in detail hereinabove, it should be clearly understood that many variations and/or modifications of the basic inventive concept herein taught, which may appear to those skilled in the art, will still fall within the spirit and scope of the present invention, as defined in the appended claims.

What is claimed is:

1. A cathode substrate arrangement for an electron emission device, said cathode substrate arrangement comprising:

a substrate; and an electron emission unit formed on the substrate;

said electron emission unit comprising an insulating layer disposed on the substrate, cathode electrodes disposed between the substrate and the insulating layer, and gate electrodes disposed on a side of the substrate remote from the cathode electrodes, said insulating layer insulating the cathode and gate electrodes from each other;

said insulating layer and said gate electrodes being discontinuous so as to form openings therein, said openings comprising electron emission regions connected to said cathode electrodes;

wherein a surface of the substrate satisfies the following condition:

$$0.5\ \text{nm} \leqq Ra \leqq 1.8\ \text{nm}$$

where Ra indicates an average roughness of the surface of the substrate.

2. The cathode substrate arrangement for an electron emission device of claim 1, wherein the electron emission regions are formed with cold cathode electron sources.

3. The cathode substrate arrangement for an electron emission device of claim 1, wherein the insulating layer has a thickness in a range of 5~15 μm.

4. The cathode substrate arrangement for an electron emission device of claim 1, wherein the insulating layer has a thickness not greater than 5 μm.

5. The cathode substrate arrangement of claim 1, wherein the cathode electrodes and the gate electrodes extend in respective directions perpendicular to each other.

6. The cathode substrate arrangement of claim 1, wherein the electron emission regions are formed with a material selected from the group consisting of carbon nanotube, graphite, graphite nanofiber, diamond, diamond-like carbon, $C_{60}$ and silicon nanowire.

7. An electron emission device, comprising:

first and second substrates facing each other with a predetermined distance therebetween;

an electron emission unit formed on a surface of the first substrate facing the second substrate; and a light emission unit formed on a surface of the second substrate facing the first substrate and including phosphor layers and an anode electrode;

said electron emission unit comprising an insulating layer disposed on the substrate, cathode electrodes disposed between the substrate and the insulating layer, and gate electrodes disposed on a side of the substrate remote from the cathode electrodes, said insulating layer insulating the cathode and gate electrodes from each other;

said insulating layer and said gate electrodes being discontinuous so as to form openings therein, said openings comprising electron emission regions connected to said cathode electrodes;

wherein the surface of the first substrate satisfies the following condition:

$$0.5\ \text{nm} \leqq Ra \leqq 1.8\ \text{nm}$$

where Ra indicates an average roughness of the surface of the first substrate facing the second substrate.

8. The electron emission device of claim 7, wherein the electron emission regions are formed with cold cathode electron sources.

9. The electron emission device of claim 7, wherein the cathode electrodes and the gate electrodes extend in respective directions perpendicular to each other.

10. The electron emission device of claim 7, wherein the electron emission regions are formed with a material selected from the group consisting of carbon nanotube, graphite, graphite nanofiber, diamond, diamond-like carbon, $C_{60}$ and silicon nanowire.

11. The electron emission device of claim 7, wherein the insulating layer has a thickness in a range of 5~15 μm.

12. The electron emission device of claim 7, wherein the insulating layer has a thickness not greater than 5 μm or less.

13. A cathode substrate arrangement for an electron emission device, said cathode substrate arrangement comprising:

a substrate; and an electron emission unit formed on the substrate and including electron emission regions, a plurality of driving electrodes, and an insulating layer for insulating the driving electrodes from each other;

wherein a surface of the substrate satisfies the following condition:

$$1.0\ \text{nm} \leqq \bullet Ra \bullet \leqq 1.8\text{nm}$$

where Ra indicates an average roughness of the surface of the substrate.

* * * * *